US011760086B2

(12) United States Patent
Sheflin et al.

(10) Patent No.: US 11,760,086 B2
(45) Date of Patent: Sep. 19, 2023

(54) SYSTEM AND METHOD FOR PRINTING COLOR IMAGES ON SUBSTRATES IN AN INKJET PRINTER

(71) Applicant: Xerox Corporation, Norwalk, CT (US)

(72) Inventors: Joseph C. Sheflin, Macedon, NY (US); Palghat S. Ramesh, Pittsford, NY (US); Anthony S. Condello, Webster, NY (US); Jack T. LeStrange, Macedon, NY (US); Peter Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 23 days.

(21) Appl. No.: 17/485,731

(22) Filed: Sep. 27, 2021

(65) Prior Publication Data

US 2023/0094021 A1 Mar. 30, 2023

(51) Int. Cl.

| | |
|---|---|
| ***B41J 2/045*** | (2006.01) |
| ***B41J 11/00*** | (2006.01) |
| ***B41J 2/21*** | (2006.01) |

(52) U.S. Cl.

CPC ..... *B41J 2/0456* (2013.01); *B41J 2/04586* (2013.01); *B41J 2/2103* (2013.01); *B41J 11/0015* (2013.01)

(58) Field of Classification Search

None

See application file for complete search history.

(56) References Cited

U.S. PATENT DOCUMENTS

| | | | | |
|---|---|---|---|---|
| 5,528,271 | A | 6/1996 | Ebisawa | |
| 6,886,905 | B2 | 5/2005 | McElfresh et al. | |
| 9,539,817 | B2 | 1/2017 | Condello et al. | |
| 2014/0176654 | A1* | 6/2014 | Hawryschuk | B41J 2/01 347/102 |
| 2020/0130350 | A1* | 4/2020 | Hara | B41J 11/0022 |
| 2021/0070063 | A1* | 3/2021 | Condello | B41J 2/21 |

* cited by examiner

*Primary Examiner* — Justin Seo
*Assistant Examiner* — Tracey M McMillion
(74) *Attorney, Agent, or Firm* — Maginot Moore & Beck LLP

(57) ABSTRACT

A method of operating a printer separates the image content data for a sheet in a print job into multiple color separations and operates a digital air curtain between the printhead modules that print the multiple color separations. Image data of the printed color separations are used to adjust operating parameters for the digital air curtain.

17 Claims, 11 Drawing Sheets

DRYING vs TIME at 25C

| Time (s) | gsm of water evaporated | Fraction evaporated |
|---|---|---|
| 0.09 | 0.05 | 0.05 |
| 1 | 0.28 | 0.28 |
| 2 | 0.55 | 0.55 |
| 3 | 0.83 | 0.83 |
| 6 | 1.65 | 1.65 |

FIG. 3B

| | $h_{air}$=100W/m^2-degK, $T_{air}$=100C | | | | $h_{air}$=100W/m^2-degK, $T_{air}$=50C | | | | $h_{air}$=200W/m^2-degK, $T_{air}$=100C | | | |
|---|---|---|---|---|---|---|---|---|---|---|---|---|
| Time (s) | $T_{ink}$ | Tp | gms of water evaporant ed | Fraction evaporant ed | $T_{ink}$ | Tp | gms of water evaporant ed | Fraction evaporant ed | $T_{ink}$ | Tp | gms of water evaporant ed | Fraction evaporant ed |
| 0.19 | 26 | 30 | 0.53 | 23% | 23 | 27 | 0.49 | 21% | 26 | 34 | 1.08 | 46% |
| 1 | 27 | 46 | 2.95 | 126% | 18 | 32 | 2.21 | 95% | 28 | 62 | 6.09 | 260% |
| 2 | 28 | 62 | 6.09 | 260% | 16 | 37 | 3.98 | 170% | 28 | 80 | 12.45 | 533% |
| 3 | 28 | 73 | 9.26 | 396% | 15 | 41 | 5.61 | 240% | 28 | 90 | 18.82 | 806% |
| 6 | 28 | 90 | 18.82 | 806% | 15 | 47 | 10.35 | 443% | 28 | 99 | 37.95 | 1624% |

FIG. 4C

SYSTEM AND METHOD FOR PRINTING COLOR IMAGES ON SUBSTRATES IN AN INKJET PRINTER

TECHNICAL FIELD

This disclosure relates generally to devices that produce ink images on media, and more particularly, to the image quality of the images produced by such devices.

BACKGROUND

Inkjet imaging devices, also known as inkjet printers, eject liquid ink from printheads to form images on an image receiving surface. The printheads include a plurality of inkjets that are arranged in an array. Each inkjet has a thermal or piezoelectric actuator that is coupled to a printhead controller. The printhead controller generates firing signals that correspond to digital data content corresponding to images. The actuators in the printheads respond to the firing signals by expanding into an ink chamber to eject ink drops onto an image receiving member and form an ink image that corresponds to the digital image content used to generate the firing signals. The image receiving member can be a continuous web of media material or a series of media sheets.

Inkjet printers used for producing color images typically include multiple printhead assemblies. Each printhead assembly includes one or more printheads that typically eject a single color of ink. In a typical inkjet color printer, four printhead assemblies are positioned in a process direction with each printhead assembly ejecting a different color of ink. The four ink colors most frequently used are cyan, magenta, yellow, and black. The common nomenclature for such printers is CMYK color printers. Some CMYK printers have two printhead assemblies that print each color of ink. The printhead assemblies that print the same color of ink are offset from each other by one-half of the distance between adjacent printheads in the cross-process direction to double the pixels per inch density of a line of the color of ink ejected by the printheads in the two assemblies. As used in this document, the term "process direction" means the direction of movement of the image receiving members as they pass the printheads in the printer and the term "cross-process direction" means a direction that is perpendicular to the process direction in the plane of the image receiving members.

High quality prints increasingly use coated substrates for brochures, magazine covers, and the like. These coated substrates, especially when moved at high speeds past the printheads, produce challenges for the quality of color ink images because the different colored inks overlay one another and are not readily absorbed by the coated substrates. Consequently, they spread over the surface of the coated substrates before the substrates enter a dryer that removes water and solvents from the ink to fix the image to the coated substrates. These unabsorbed inks produce an image defect known as overlay graininess. Developing inkjet color printers that enable ink images on coated substrates to be produced with little or no overlay graininess would be beneficial.

SUMMARY

A color inkjet printer is configured to produce color images on coated substrates with little or no overlay graininess. The color inkjet printer includes a first printhead module configured to eject a first ink having a first color, a second printhead module configured to eject a second ink having a second color that is different than the first color, the second printhead module following the first printhead module in a process direction, a first heated air source positioned after the first printhead module in the process direction and positioned before the second printhead module in the process direction, an optical sensor configured to generate image data of substrates printed by the first printhead module and the second printhead module, the optical sensor being positioned after the second printhead module in the process direction, and a controller operatively connected to the first printhead module, the second printhead module, the first heated air source, and the optical sensor. The controller is configured to receive image content data for a substrate in a print job, generate at least a first color separation and a second color separation using the image content data for the substrate, operate the first printhead module to print the first color separation onto the substrate, operate the first heated air source to direct heated air toward the substrate after the first color separation has been printed on the substrate but before the second color separation is printed on the substrate, operate the second printhead module to print the second color separation onto the substrate immediately after the substrate has passed the heated air source, and use image data of the printed first color separation and the printed second color separation generated by the optical sensor to adjust operating parameters for the first heated air source.

A method of operating a color inkjet printer produces color images on coated substrates with little or no overlay graininess. The method includes receiving image content data for a substrate in a print job, generating at least a first color separation and a second color separation using the image content data for the substrate, operating a first printhead module to print the first color separation onto the substrate, operating a first heated air source to direct heated air toward the substrate after the first color separation has been printed on the substrate but before the second color separation is printed on the substrate, operating a second printhead module to print the second color separation onto the substrate immediately after the substrate has passed the first heated air source, and using image data of the printed first color separation and the printed second color separation to adjust operating parameters for the first heated air source.

BRIEF DESCRIPTION OF THE DRAWINGS

The foregoing aspects and other features of a color inkjet printer and color inkjet printer operational method that produces color images on coated substrates with little or no overlay graininess are explained in the following description, taken in connection with the accompanying drawings.

FIG. 3B is a chart of drying times between color separation printings and the amount of water removed from aqueous ink forming the color separations.

FIG. 4C is a chart of three color separation printing scenarios.

DETAILED DESCRIPTION

Figure 1:
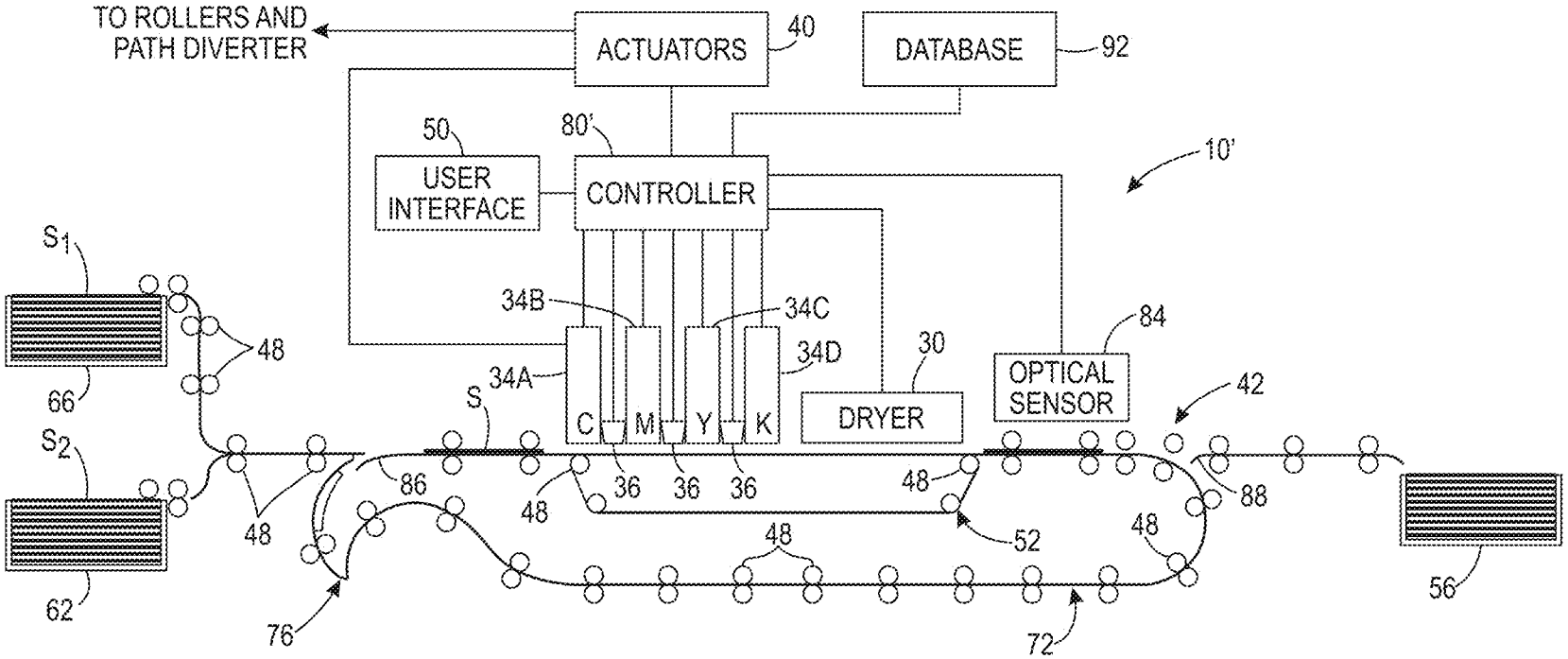
FIG. 1 is a schematic drawing of a color inkjet printer that produces color images on coated substrates with little or no overlay graininess.

For a general understanding of the environment for the printer, the printer operational method, and printer configuration method disclosed herein as well as the details for the printer, the printer operational method, and printer configuration method, reference is made to the drawings. In the drawings, like reference numerals have been used throughout to designate like elements. As used herein, the word "printer" encompasses any apparatus that ejects ink drops onto different types of media to form ink images.

Figure 7:
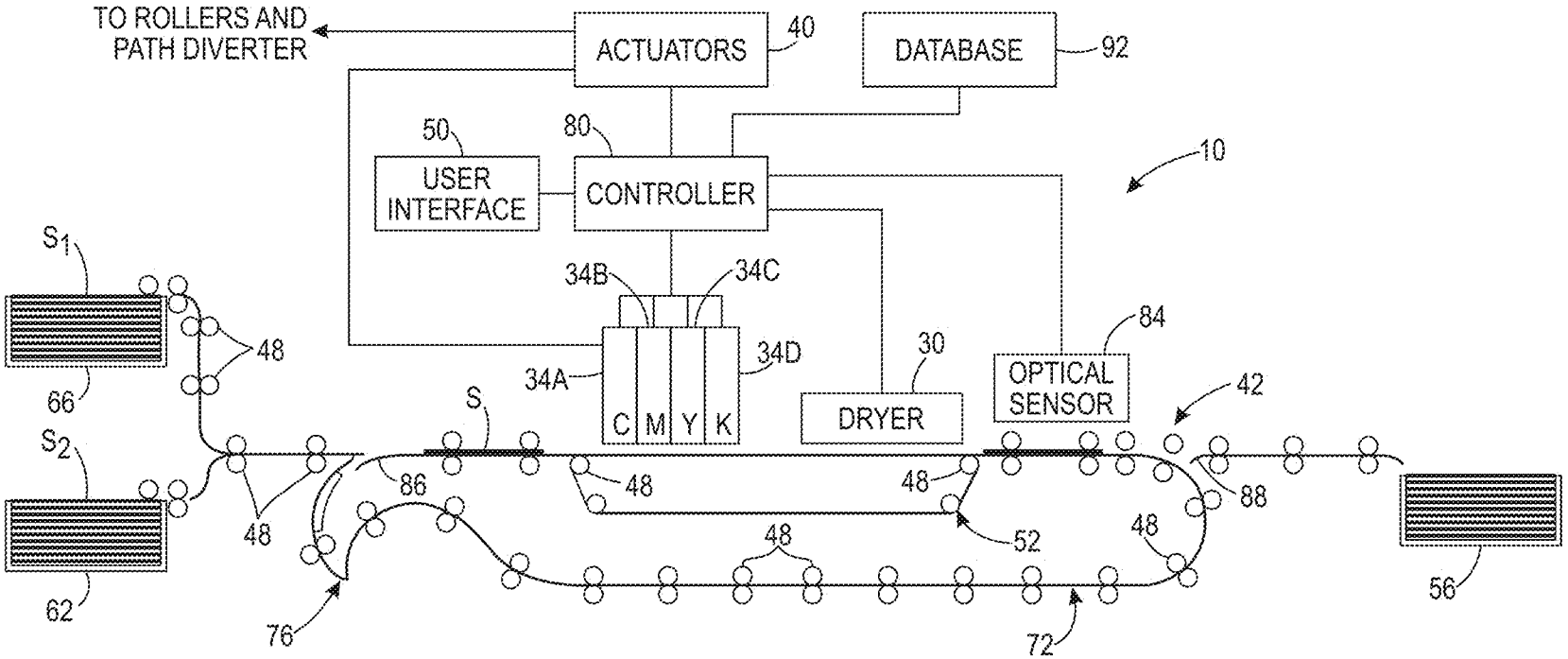
FIG. 7 PRIOR ART
FIG. 7 is a schematic drawing of a prior art color inkjet printer that cannot produce color images on coated substrates with little or no overlay graininess.

FIG. 7 depicts a prior art high-speed color inkjet printer 10 that cannot produce color images on coated substrates with little or no overlay graininess. As illustrated, the printer 10 is a printer that directly forms an ink image on a surface of a media sheet stripped from one of the supplies of media sheets $S_1$ or $S_2$ and the sheets S are moved through the printer 10 by the controller 80 operating one or more of the actuators 40 that are operatively connected to rollers or to at least one driving roller of conveyor 52 that comprise the media transport 42. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads within a module or between modules can also be interlaced so the density of the drops ejected by the printheads in the cross-process direction can be greater than the smallest spacing between the inkjets in a printhead in the cross-process direction. Although printer 10 is depicted with only two supplies of media sheets, the printer can be configured with three or more sheet supplies, each containing a different type or size of media.

Figure 8:
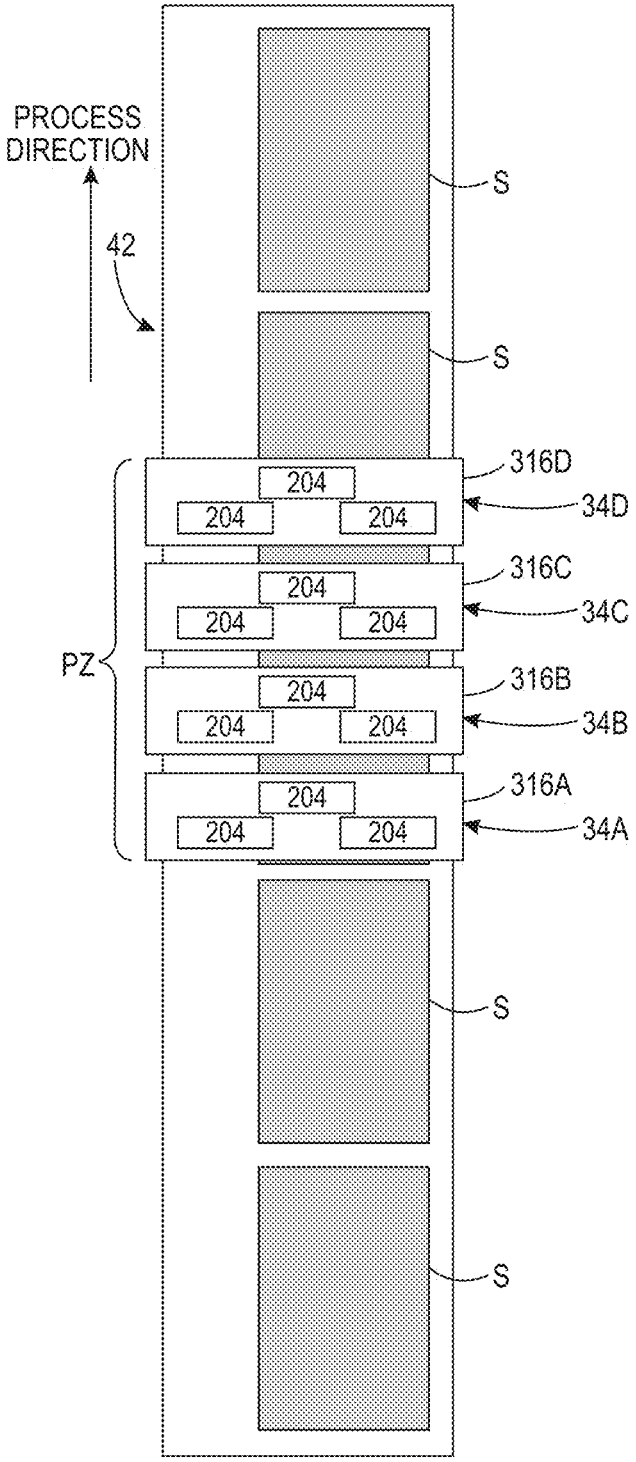
FIG. 8 PRIOR ART
FIG. 8 depicts the print zone in the printer of FIG. 7.

The print zone PZ in the prior art printer of FIG. 7 is shown in FIG. 8. The print zone PZ has a length in the process direction commensurate with the distance from the first inkjets that a sheet passes in the process direction to the last inkjets that a sheet passes in the process direction and it has a width that is the maximum distance between the most outboard inkjets on opposite sides of the print zone that are directly across from one another in the cross-process direction. Each printhead module 34A, 34B, 34C, and 34D shown in FIG. 8 has three printheads 204 mounted to a printhead carrier plate 316A, 316B, 316C, and 316D, respectively.

As shown in FIG. 7, the printed image passes under an image dryer 30 after the ink image is printed on a sheet S. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air using a fan or other pressurized source of air over the ink to supplement the evaporation of the water or solvent from the ink. The air is then collected and evacuated by air returns to reduce the interference of the dryer air flow with other components in the printer.

A duplex path 72 is provided to receive a sheet from the transport system 42 after a substrate has been printed and move it by the rotation of rollers in an opposite direction to the direction of movement past the printheads. At position 76 in the duplex path 72, the substrate can be turned over so it can merge into the job stream being carried by the media transport system 42. The controller 80 is configured to flip the sheet selectively. That is, the controller 80 can operate actuators to turn the sheet over so the reverse side of the sheet can be printed or it can operate actuators so the sheet is returned to the transport path without turning over the sheet so the printed side of the sheet can be printed again. Movement of pivoting member 88 provides access to the duplex path 72. Rotation of pivoting member 88 is controlled by controller 80 selectively operating an actuator 40 operatively connected to the pivoting member 88. When pivoting member 88 is rotated counterclockwise as shown in FIG. 7, a substrate from media transport 42 is diverted to the duplex path 72. Rotating the pivoting member 88 in the clockwise direction from the diverting position closes access to the duplex path 72 so substrates on the media transport continue moving to the receptacle 56. Another pivoting member 86 is positioned between position 76 in the duplex path 72 and the media transport 42. When controller 80 operates an actuator to rotate pivoting member 86 in the counterclockwise direction, a substrate from the duplex path 72 merges into the job stream on media transport 42. Rotating the pivoting member 86 in the clockwise direction closes the duplex path access to the media transport 42.

As further shown in FIG. 7, the printed media sheets S not diverted to the duplex path 72 are carried by the media transport to the sheet receptacle 56 in which they are be collected. Before the printed sheets reach the receptacle 56, they pass by an optical sensor 84. The optical sensor 84 generates image data of the printed sheets and this image data is analyzed by the controller 80, which is configured to determine which inkjets, if any, that were operated to eject ink did in fact do so or if they did not eject an ink drop having an appropriate mass or that landed errantly on the sheet. Any inkjet operating in this manner is called an inoperative inkjet in this document. The controller can store data identifying the inoperative inkjets in a memory operatively connected to the controller. A user can operate the user interface 50 to obtain reports displayed on the interface that identify the number of inoperative inkjets and the printheads in which the inoperative inkjets are located. The optical sensor can be a digital camera, an array of LEDs and photodetectors, or other devices configured to generate image data of a passing surface. As already noted, the media transport also includes a duplex path that can turn a sheet over and return it to the transport prior to the printhead modules so the opposite side of the sheet can be printed. While FIG. 7 shows the printed sheets as being collected in the sheet receptacle, they can be directed to other processing stations (not shown) that perform tasks such as folding, collating, binding, and stapling of the media sheets.

Operation and control of the various subsystems, components and functions of the machine or printer 10 are performed with the aid of a controller or electronic subsystem (ESS) 80. The ESS or controller 80 is operably connected to the components of the printhead modules 34A-34D (and thus the printheads), the actuators 40, and the dryer 30. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares, and manages the image data flow between image input sources, such as a scanning system or an online or a work station connection (not shown), and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image content data for an image to be produced are sent to the controller 80 from either a scanning system or an online or work station connection for processing and generation of the printhead control signals output to the printhead modules 34A-34D. Along with the image content data, the controller receives print job parameters that identify the media weight, media dimensions, print speed, media type, ink area coverage to be produced on each side of each sheet, location of the image to be produced on each side of each sheet, media color, media fiber orientation for fibrous media, print zone temperature and humidity, media moisture content, and media manufacturer. As used in this document, the term "print job parameters" means non-image content data for a print job and the term "image content data" means digital data that identifies an ink image to be printed on a media sheet.

Figure 2:
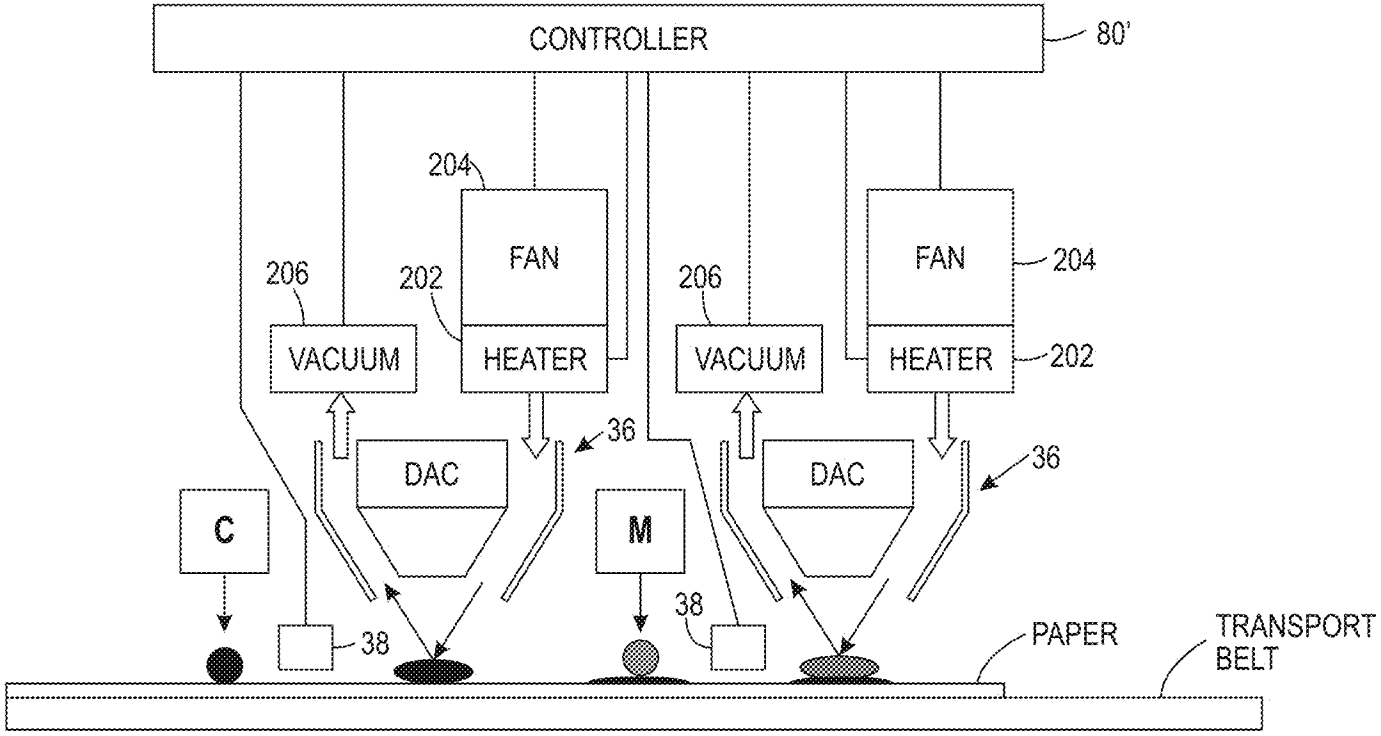
FIG. 2 depicts a pair of digital air curtains in the printer of FIG. 1 that enable the printer to produce color images on coated substrates with little or no overlay graininess.

Using like reference numbers to identify like components, FIG. 1 depicts a high-speed color inkjet printer 10' in which digital air curtains (DAC) 36 have been installed between adjacent printhead modules in the process direction and a controller 80' has been configured to perform the process 500 described below to produce color images on coated substrates with little or no overlay graininess. FIG. 2 depicts two of the DACs 36. A single DAC 36 is interspersed between adjacent printheads in this configuration although other arrangements of DACs are possible as discussed below. Each DAC 36 includes a heater 202, which heats a flow of air produced by a source of variable positive air flow 204. The DAC includes a housing that is configured to direct the heated air onto the top of the ink layer passing by the printheads. This heated air flow provides both a leveling force to the ink layer ejected onto a substrate by the previous printhead as well as a drying component for the ink layer. The heater 202 and the source of variable positive air flow 204 are connected to controller 80' so the controller can vary the operation of the heater and air flow source to adjust the temperature and rate of the air flow to control ink dot spread in the print zone. A vacuum 206 is also operatively connected to the controller 80' so the controller can operate the vacuum to remove moisture and mitigate the impact of the heated air flow on the freshly ejected ink drops. The heater 202 can be an inline cartridge heater or the like. In addition to control the air flow rate, the controller 80' is configured to operate the source of the air flow digitally using the timing of a paper edge sensor 38 to pulse the air flow source on and off so the paper does not detach from the transport belt.

Figure 6:
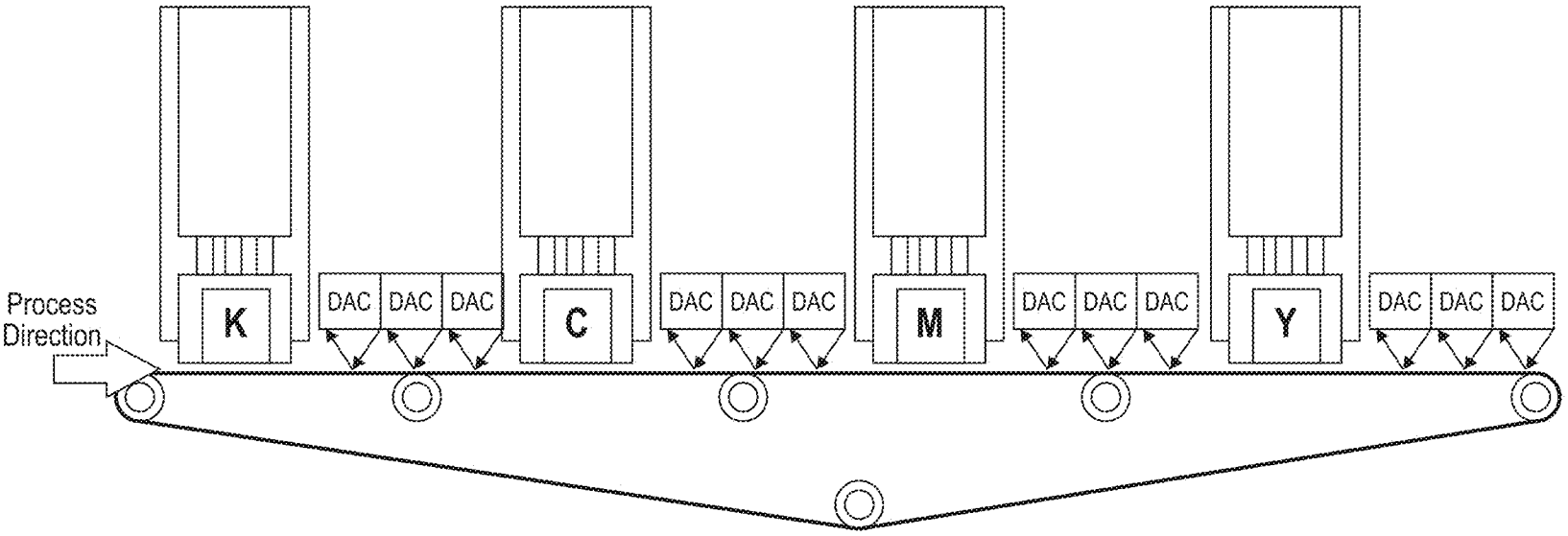
FIG. 6 is alternative arrangement of digital air curtains in the printer of FIG. 1.

As shown in FIG. 1 and FIG. 2, a single DAC 36 is positioned between printhead modules. Alternative arrangements of DACs can be installed in a printer, such as printer 10' in FIG. 1, so a plurality of DACs 36 are stacked as an array between color modules. An example of an alternative arrangement is shown in FIG. 6. Such an alternative arrangement can be useful to address the issues arising from different viscosities of inks or pigments in the inks ejected by the various printhead modules or the different types of media substrates being printed. Differences between ink in the printhead modules may require that a different number of DACs 36 be located between the printhead modules. For example, one DAC between a first printhead module and a second printhead module adjacent to it in the process direction can be sufficient to control dot gain in a single color separation, while two DACs are installed between the second printhead module and a third adjacent printhead module in the process direction and three DACs are installed between the third printhead module and a fourth adjacent printhead module in the process direction.

Figure 3A:
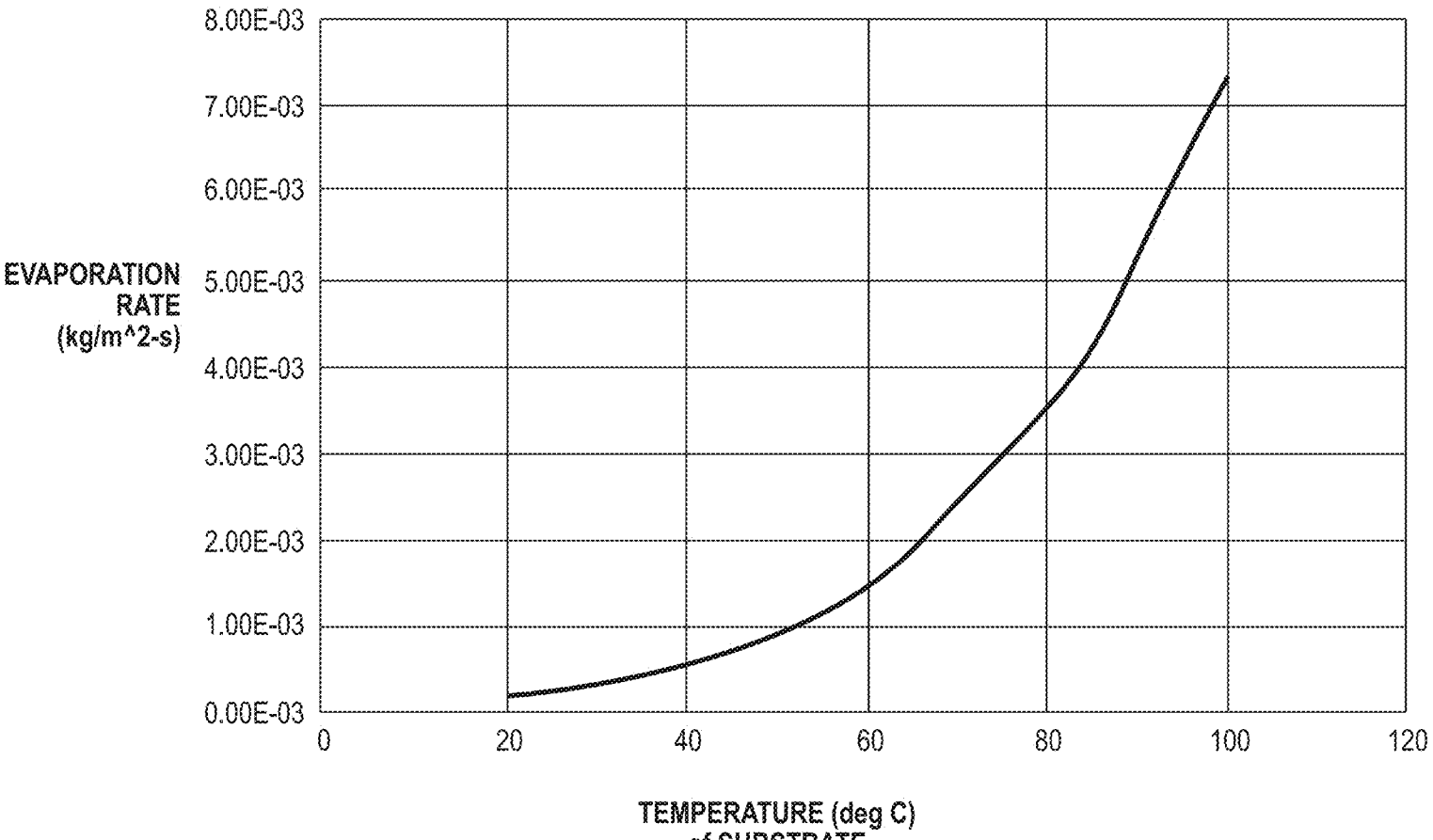
FIG. 3A is a graph of evaporation rates versus temperature.

Experiments were conducted using a printer similar to the one shown in FIG. 6. Each printhead module, ejecting only one color of aqueous ink, printed a test pattern of lines extending in the process direction on a substrate passing the printheads in the printhead modules. The time between the printing of the substrate by one printhead module and its printing by the subsequent printhead module was varied. The substrate was not heated above the ambient air temperature, which was 25° C. After the substrate was printed, the printed lines were imaged and the image data analyzed to measure the overlay graininess. The measurements indicated that overlay graininess was within image quality specifications when the time between printings by the printhead modules was at least 3 seconds. Using the known evaporation rate of water at a substrate temperature of 25° C. identified in the graph of FIG. 3A, the known mass of the ink ejected by each printhead module, the heat transfer coefficient between the air and the substrate of 10 $W/m^2$-deg K, and the 3 second time interval, the amount of water evaporation required between printhead module printings to achieve acceptable image quality was identified. One such experiment resulted in the chart shown in FIG. 3C, which indicates 35% of the water content of the aqueous ink ejected onto the substrate by a printhead module needed to be evaporate to achieve acceptable image quality.

Figure 4A:
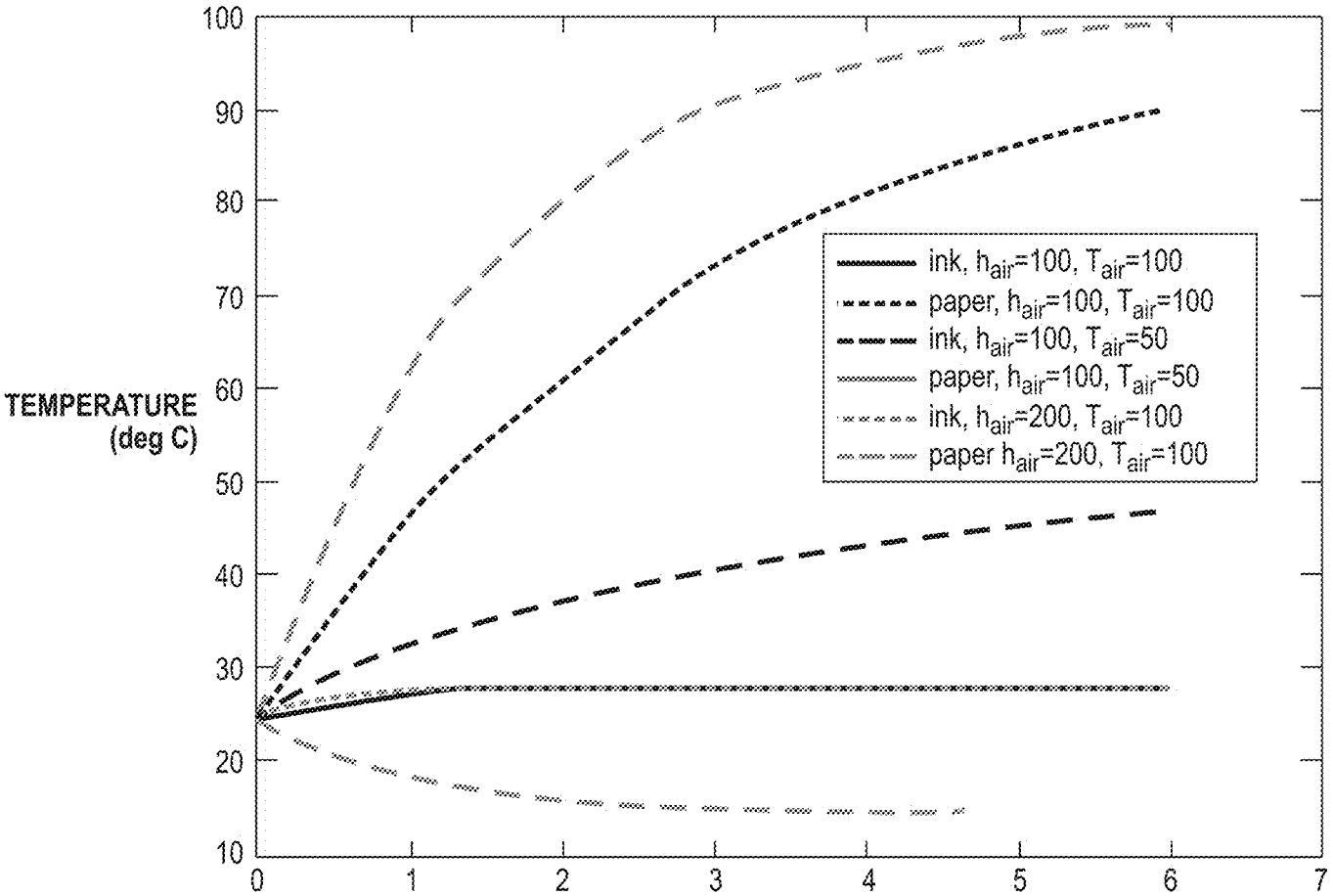
FIG. 4A is a graph of ink and substrate temperature versus drying times.
Figure 4B:
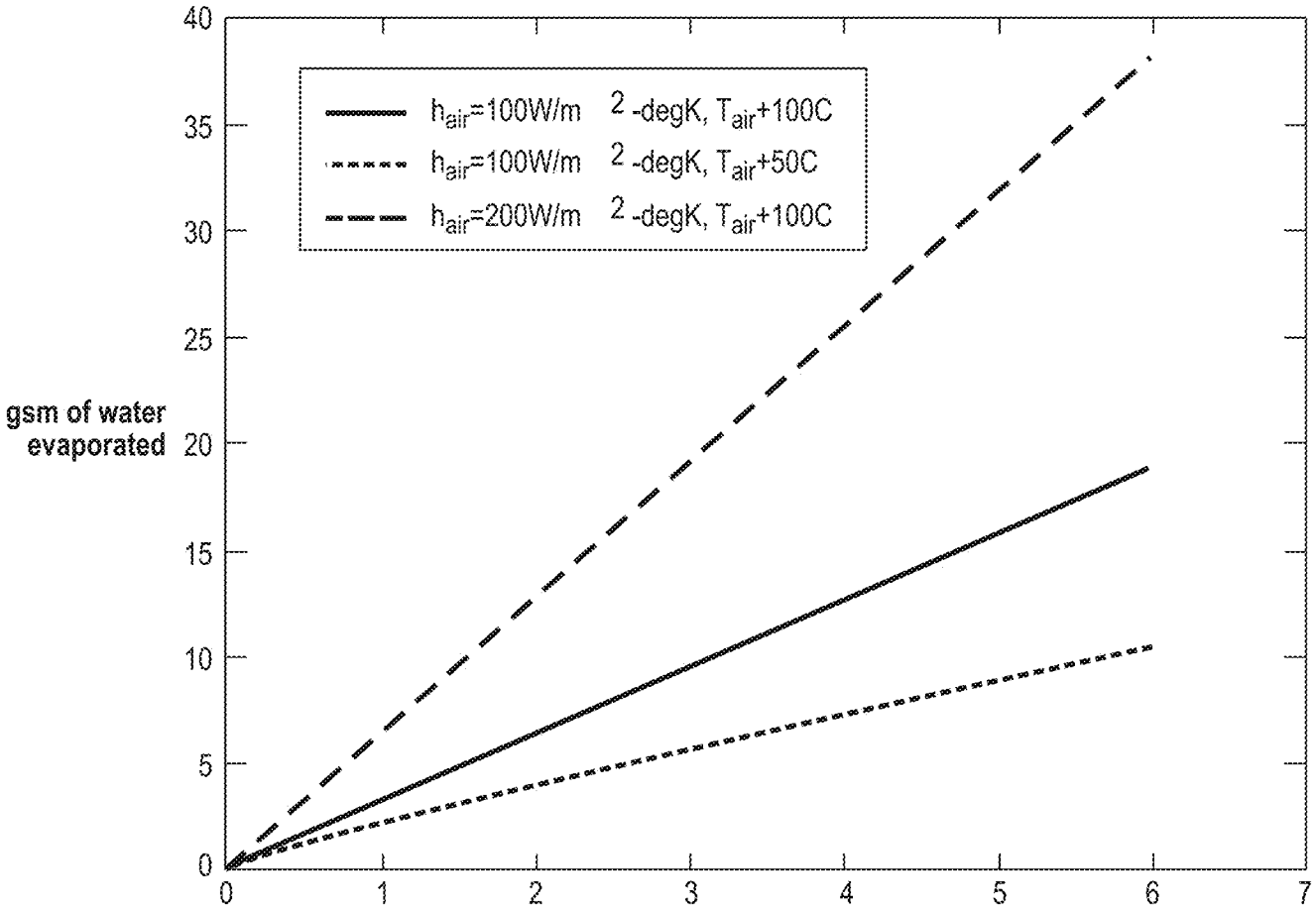
FIG. 4B is graph of water evaporated from aqueous ink forming color separations.

Using this information, three scenarios were modeled in which heated air flow was directed onto the ink and paper between the printings by each printhead module. The scenarios had different heat transfer coefficients and air temperatures for the heated air impinging the ink. Heat transfer coefficients are a function of air flow measured in cubic feet per minute (cfm), the dimensions of the air flow chute opening directing the heated air flow toward the sheets, and the distance between the air flow opening and the sheets. For a fixed geometry of the air flow opening and distance from the opening to the sheets, the heat transfer rates are regulated by modulating the airflow rate within a range that does not disturb the ink images on the sheets. Standard heat transfer coefficients for laminar and turbulent flow scenarios are used for given flow rates and geometry. A graph of the temperatures of the ink and the substrate areas with no ink on it are shown in FIG. 4A. The graph of FIG. 4B shows the corresponding grams of water per square meter of substrate (gsm) that was evaporated over time. A chart of these results for the time intervals shown in FIG. 3B is shown in FIG. 4C. These data demonstrate that the temperature of the heated air produced by a DAC 36 and the rate at which the heated air is directed onto a substrate passing the DAC 36 can be regulated to obtain ink drying between color separations sufficient to attenuate overlay graininess. One constraint on the temperature of the unprinted areas of the substrate for this particular media requires the temperature of these areas to be less 37° C. since temperatures above that level tend to dry out the inkjets and cause inoperative inkjets. As used in this document, the term "color separation" means an arrangement of a plurality of pixels of a single color to be printed or have been printed by a printhead module.

In the printer of FIG. 1, the optical sensor generates image data of the ink images printed on the substrates while the DACs 36 are operated with initial conditions for the air temperature, air flow rate, and vacuum levels. The controller 80' analyzes the image data to measure the size of the ink drops (dot gain) or lines of ink (line growth) in the various color separations forming the ink images. Both dot gain and line growth indicate the amount of ink drop spreading occurring during the printing of an ink image. If it is too large, overlay graininess occurs. Alternatively or additionally to the use of the ink images of a print job, test patterns of ink drops or ink lines can be printed within the ink image area or margins outside the ink image area for dot gain and line growth measurement purposes. The dot gain and line growth is measured for each color separation as well as the overlays of two or more of the color separations to evaluate the interaction between color separations. If the measured dot gain or line growth exceeds a predetermined threshold, one or more of air temperature, flow rate, and vacuum level are increased. Image data of subsequent ink images are analyzed to determine whether the change or changes were adequate to address the measured dot gain or line growth. If the change or changes did not result in dot gain or line growth being less than the predetermined threshold, further increases in one or more of these parameters are made. The DACs 36 are independently controlled because the inks ejected by the various printhead modules are different in color (pigments) and viscosity. Thus, operational parameters for one or more DACs that direct air onto the first color separation are likely to be different than the operational parameters for the one or more DACs treating combinations of color separations. Likewise, in embodiments having a plurality of DACs between adjacent printhead modules, each DAC in the plurality of DACs can be independently operated with respect to one another and with respect to DACs between other adjacent printhead modules.

Figure 5:
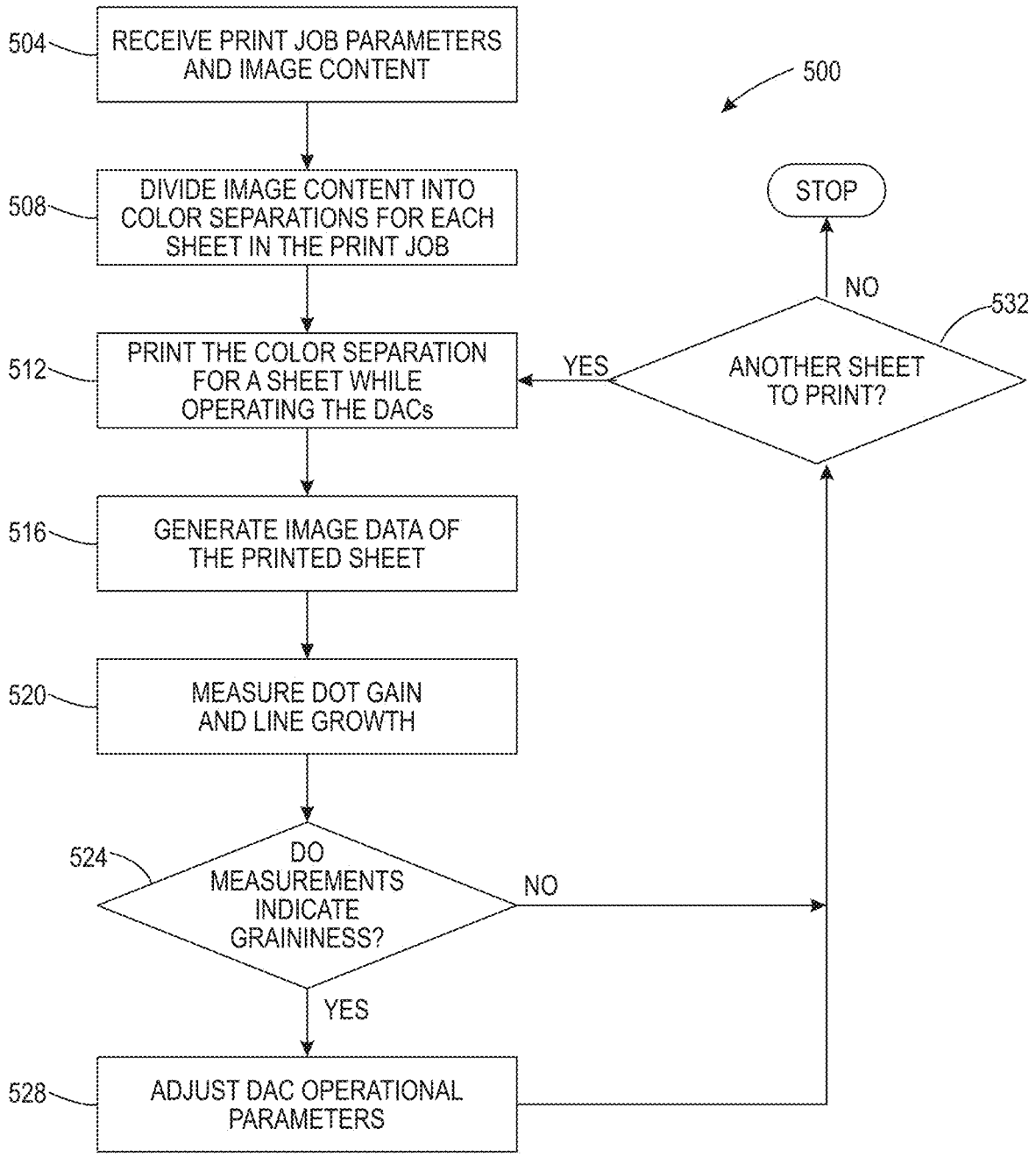
FIG. 5 is a flow diagram of a process for operating the printer of FIG. 1 to produce color images on coated substrates with little or no overlay graininess.

FIG. 5 depicts a flow diagram for a process 500 that operates the printer 10' to register the printing of a second color image with a previously printed color image on a media sheet. In the discussion below, a reference to the process 500 performing a function or action refers to the operation of a controller, such as controller 80, to execute stored program instructions to perform the function or action in association with other components in the printer. The process 500 is described as being performed with the printer 10' of FIG. 1 for illustrative purposes.

The process 500 of operating the printer 10' begins with the controller receiving the parameters and the image content data for a print job (block 504). The image content data for each sheet is divided into a color separation for each printhead module (block 508). The process prints each color separation and operates the DACs between the printhead modules (block 512). The optical sensor generates image data of the ink images formed with the printed color separations (block 516) and the dot gain and line growth of ink drops and lines in the image data of the ink image are measured (block 520). If the measured dot gain or line growth for a color separation exceeds a predetermined threshold corresponding to the onset of overlay graininess (block 524), then the process increases one or more of the operating parameters for the DAC or DACs treating that color separation (block 528). The process continues until all of the ink images have been printed (block 532).

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A color inkjet printer comprising:

a first printhead module configured to eject a first ink having a first color;

a second printhead module configured to eject a second ink having a second color that is different than the first color, the second printhead module following the first printhead module in a process direction;

a first heated air source positioned after the first printhead module in the process direction and positioned before the second printhead module in the process direction;

an optical sensor configured to generate image data of substrates printed by the first printhead module and the second printhead module, the optical sensor being positioned after the second printhead module in the process direction; and a controller operatively connected to the first printhead module, the second printhead module, the first heated air source, and the optical sensor, the controller being configured to:

receive image content data for a substrate in a print job;

generate at least a first color separation and a second color separation using the image content data for the substrate;

operate the first printhead module to print the first color separation onto the substrate;

operate the first heated air source to direct heated air having a first temperature and a first air flow rate toward the substrate after the first color separation has been printed on the substrate but before the second color separation is printed on the substrate;

operate the second printhead module to print the second color separation onto the substrate immediately after the substrate has passed the first heated air source;

measure a size of ink drops in the image data of the printed first color separation and the printed second color separation generated by the optical sensor; and vary operation of the first heated air source to adjust at least one of the first temperature of the heated air and the air flow rate of the heated air when the measured size of at least some of the ink drops in the image data of the printed first color separation and the printed second color separation exceeds a predetermined threshold.

2. The color inkjet printer of claim 1 further comprising:

a first vacuum source configured to pull the heated air away from the substrate after the heated air has reached the substrate.

3. The color inkjet printer of claim 2, the controller being further configured to:

adjust a level of vacuum pulled by the first vacuum source when the measured size of at least some of the ink drops in the printed first color separation and the printed second color separation exceeds a predetermined threshold.

4. The color inkjet printer of claim 3 further comprising:

a third printhead module configured to eject a third ink having a third color that is different than the first color and the second color, the printhead module following the first printhead module and the second printhead module in the process direction;

a second heated air source positioned after the second printhead module in the process direction and positioned before the third printhead module in the process direction;

the controller being further operatively connected to the third printhead module and the second heated air source, the controller being further configured to:

generate a third color separation using the image content data for the substrate;

operate the second heated air source to direct heated air toward the substrate after the second color separation has been printed on the substrate but before the third color separation is printed on the substrate;

operate the third printhead module to print the third color separation onto the substrate immediately after the substrate has passed the second heated air source; and use image data of the printed third color separation generated by the optical sensor to adjust operating parameters for the second heated air source.

5. The color inkjet printer of claim 1, the first heated air source further comprising:

a first plurality of heated air sources; and the controller being further operatively connected to each heated air source in the first plurality of heated air sources, the controller being further configured to:

use the image data of the printed first color separation, the printed second color separation, and the third printed color separation generated by the optical sensor to adjust at least one of the operating parameter for at least one heated air source in the first plurality of heated air sources.

6. The color inkjet printer of claim 5, the second heated air source further comprising:

a second plurality of heated air sources; and the controller being further operatively connected to each heated air source in the second plurality of heated air sources, the controller being further configured to:

use the image data of the printed first color separation, the printed second color separation, and the third printed color separation generated by the optical sensor to adjust at least one operating parameter for at least one heated air source in the second plurality of heated air sources.

7. The color inkjet printer of claim 6 wherein a number of heated air sources in the first plurality of heated air sources is different than a number of heated air sources in the second plurality of air sources.

8. The color inkjet printer of claim 7, the controller being further configured to control the first plurality of heated air sources independently of the second plurality of heated air sources.

9. The color inkjet printer of claim 8, the controller being further configured to control each heated air source in the first plurality of heated air sources independently of the other heated air sources in the first plurality of heated air sources.

10. The color inkjet printer of claim 9, the controller being further configured to not adjust the temperature of the heated air generated by any heated air source in the first plurality of heated sources and the second plurality of heated air sources above a maximum temperature.

11. The color inkjet printer of claim 10 wherein the maximum temperature is 37° C.

12. A method for operating a printer comprising:

receiving image content data for a substrate in a print job;

generating at least a first color separation and a second color separation using the image content data for the substrate;

operating a first printhead module to print the first color separation onto the substrate;

operating a first heated air source to direct heated air toward the substrate after the first color separation has been printed on the substrate but before the second color separation is printed on the substrate;

operating a second printhead module to print the second color separation onto the substrate immediately after the substrate has passed the first heated air source;

generating image data of the printed first color separation and the printed second color separation;

measuring a size of ink drops in the image data of the printed first color separation and the printed second color separation; and adjusting operational parameters of the first heated air source when the size of at least some of the ink drops in the image data of the printed first color separation and the printed second color separation exceeds a predetermined threshold.

13. The method of claim 12, the adjustment of the operational parameters of the first heated air source further comprises:

adjusting one of a temperature of the heated air directed toward the substrate and an air flow rate of the heated air directed toward the substrate.

14. The method of claim 13 further comprising:

operating a first vacuum source to pull the heated air away from the substrate after the heated air has reached the substrate.

15. The method of claim 14 further comprising:

adjusting a level of vacuum pulled by the first vacuum source when the measured size of at least some of the ink drops in the image data of the printed first color separation and the printed second color separation exceeds a predetermined threshold.

16. The method of claim 15 further comprising:

generating a third color separation using the image content data for the substrate;

operating a second heated air source positioned after the second printhead module to direct heated air toward the substrate after the second color separation has been printed on the substrate but before the third color separation is printed on the substrate;

operating a third printhead module to print the third color separation onto the substrate immediately after the substrate has passed the second heated air source;

generating image data of the printed first color separation, the printed second color separation, and the printed third color separation; and using the image data of the printed first color separation, the printed second color separation, and the printed third color separation to adjust operating parameters for the second heated air source.

17. The method of claim 16, the operation of the second heated air source further comprises:

operating a plurality of heated air sources; and using the image data of the printed first color separation, the printed second color separation, and the printed third color separation to adjust the operating parameters for at least one heated air source in the plurality of heated air sources.

* * * * *